United States Patent [19]

Engstrand et al.

[11] Patent Number: 5,007,985

[45] Date of Patent: Apr. 16, 1991

[54] METHOD OF REDUCING THE ENERGY CONSUMPTION AT THE REFINING OF CELLULOSE CONTAINING MATERIAL

[75] Inventors: Per O. Engstrand, Täby; Lars-Ake Hammar, Farsta; Myat T. Htun, Vällingby; Rune L. Pettersson, Stockholm, all of Sweden

[73] Assignee: STFI, Stockholm, Sweden

[21] Appl. No.: 346,270

[22] Filed: May 2, 1989

Related U.S. Application Data

[63] Continuation of Ser. No. 235,893, Aug. 11, 1988, abandoned.

[30] Foreign Application Priority Data

Apr. 18, 1986 [SE] Sweden ..... 8601779

[51] Int. Cl.[5] ..... D21B 1/16

[52] U.S. Cl. ..... 162/26; 162/90

[58] Field of Search ..... 162/26, 28, 90, 25

[56] References Cited

U.S. PATENT DOCUMENTS 3,013,932 12/1961 Hinrichs ..... 162/26
3,023,140 2/1962 Textor ..... 162/26
3,055,792 9/1962 Kueppen et al. ..... 162/26
3,597,310 8/1971 Sumi ..... 162/26
3,627,629 12/1971 Miller ..... 162/26
4,599,138 7/1986 Lindahl ..... 162/26

FOREIGN PATENT DOCUMENTS 2913354 10/1979 Fed. Rep. of Germany ..... 162/26

*Primary Examiner*—Steve Alvo

*Attorney, Agent, or Firm*—Burns, Doane, Swecker & Mathis

[57] ABSTRACT

Method of reducing the energy consumption at the refining/beating of cellulose-containing material by the addition of alkali to the material for neutralizing acid groups bonded to the fibre wall. According to the invention, the pH-value in the pulp suspension is measured at the refiner outlet, the alkali is added in an amount depending on the measured pH value for neutralization without excess in the beating zone or immediately before the material enters the same, in an amount of 0.05–9 kg/ton, preferably 0.5–5 kg/ton, suitably 1–4 kg/ton, calculated as NaOH.

1 Claim, 2 Drawing Sheets

METHOD OF REDUCING THE ENERGY CONSUMPTION AT THE REFINING OF CELLULOSE CONTAINING MATERIAL

This application is a continuation, of application Ser. No. 235,893, filed Aug. 11, 1988, now abandoned.

This invention relates to a method of reducing the energy consumption at the refining of cellulose-containing material, which is in the form of chips or fibre suspension, to specified physical properties.

The manufacture of mechanical pulp from chips and also the beating of defibered pulp for obtaining desired properties require considerable energy investment. The energy cost for the manufacture of such pulp and, respectively, for its processing in order to achieve good paperforming properties constitutes a substantial part of the manufacturing cost, and great efforts have been made in the course of years to decrease this energy consumption.

Some of these efforts were directed to the improvement of structural design details of the apparatuses used at the refining/beating, so-called refiners, but also entirely new constructions have been proposed and also taken into use. Furthermore, the refining members, the refiner disc segments, comprised in the refiners and essential for carrying out the refining, have been improved substantially both in respect of the design of the segment patterns and of the material choice and manufacturing method.

As regards the refining of chips, a pre-treatment of the chips has proved a great progress. At this treatment steam under pressure was used at the manufacture of thermomechanical pulp, but also chemicals were used at the manufacture of chemi-mechanical pulp. This development of the manufacturing methods, however, was not intended only to reduce the energy consumption, but also was intended to obtain improved properties of the pulp, and thereby also of the paper made, and to achieve new advanced products.

This development in the refiner technique has implied great steps forward, but the high energy consumption still is a great problem.

The present invention has the object to set this situation right.

The invention is based on the idea that there should be a relation between the energy consumption at the beating/refining to a certain pulp property and the chemical environment in the refiner, and especially in that area in the refiner where the fibre at the transport of the material through the equipment is exposed and, respectively, processed, viz. in the beating zone between the rotating refiner discs.

According to the invention it was found by surprise that the energy consumption can be reduced considerably if alkali is added to the cellulose material in the refiner, and the alkali is added to the material in the beating zone or immediately before the material enters thereinto. It is essential that the alkali is added without excess. The addition must be adjusted accurately and, therefore, the pH-value in the pulp suspension must be measured and the addition be made in response thereto.

It also was found according to the invention, that the alkali must be added in a certain critical amount, viz. —, 05—9 kg/ton, calculated as NaOH. The surprising technical effects achieved hereby are reported in greater detail in the following in the form of Tables and by the accompanying diagrams.

It is a known to add different chemicals to a cellulose pulp at its passage through the beating zone in a refiner. Examples of such methods are additions of sulphite solutions in order to influence the pulp properties. At the peroxide bleaching of mechanical pulps it was proposed to add the bleaching chemicals in the beating zone. The bleaching chemicals can contain, besides peroxide, silicate and complexing agents and also alkali. These methods, however, lie far beyond the scope of the present invention and are, therefore, not further discussed.

The invention is described in greater detail in the following by way of two examples reporting comparative tests and with reference to the accompanying drawings, in which

Figure 1:
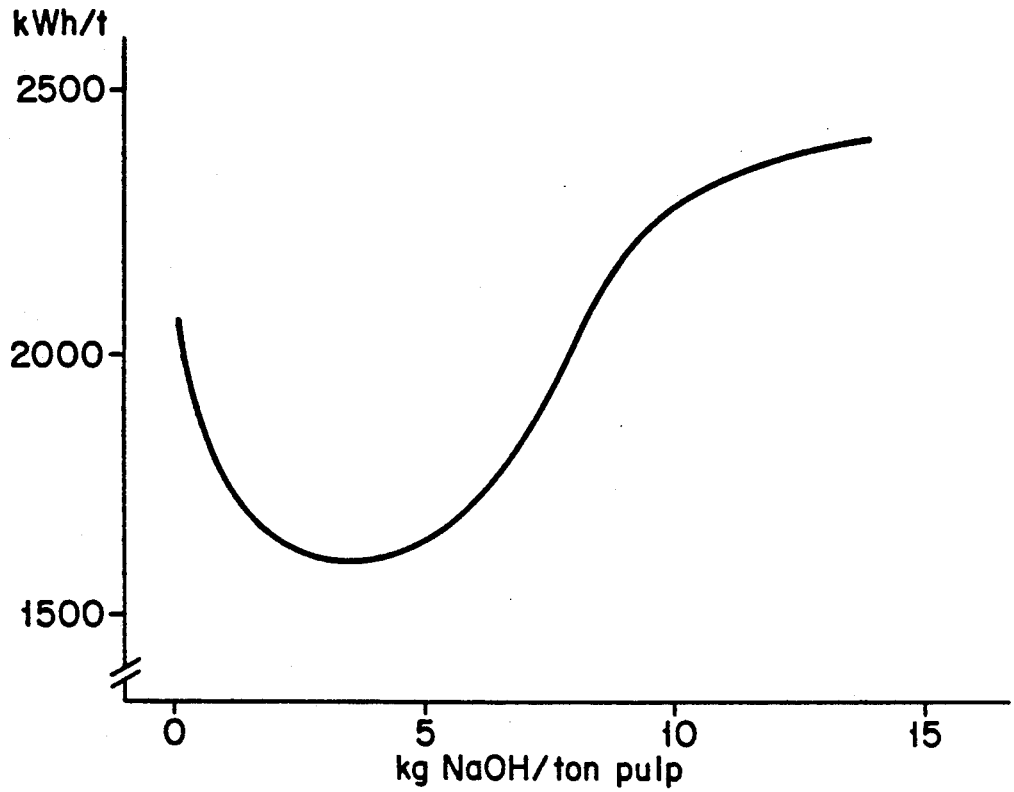
FIGS. 1 and 2 show the energy consumption as a function of the amount of alkali added at a certain indicated tensile index and, respectively, light-scattering coefficient.
Figure 2:
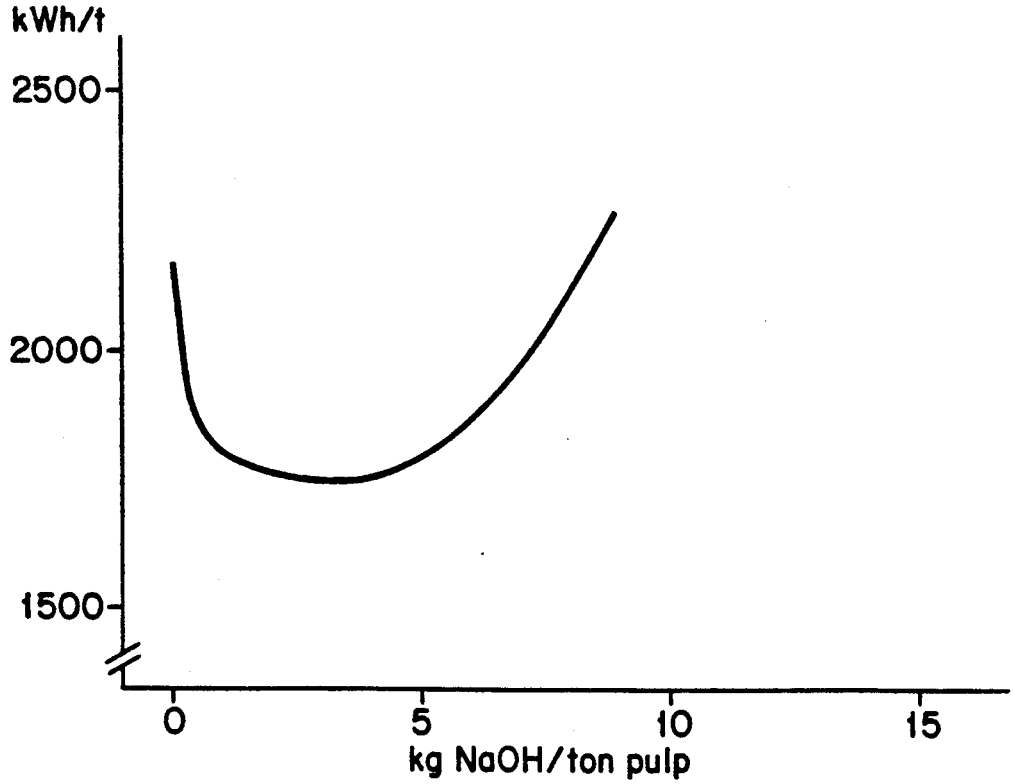
Figure 3:
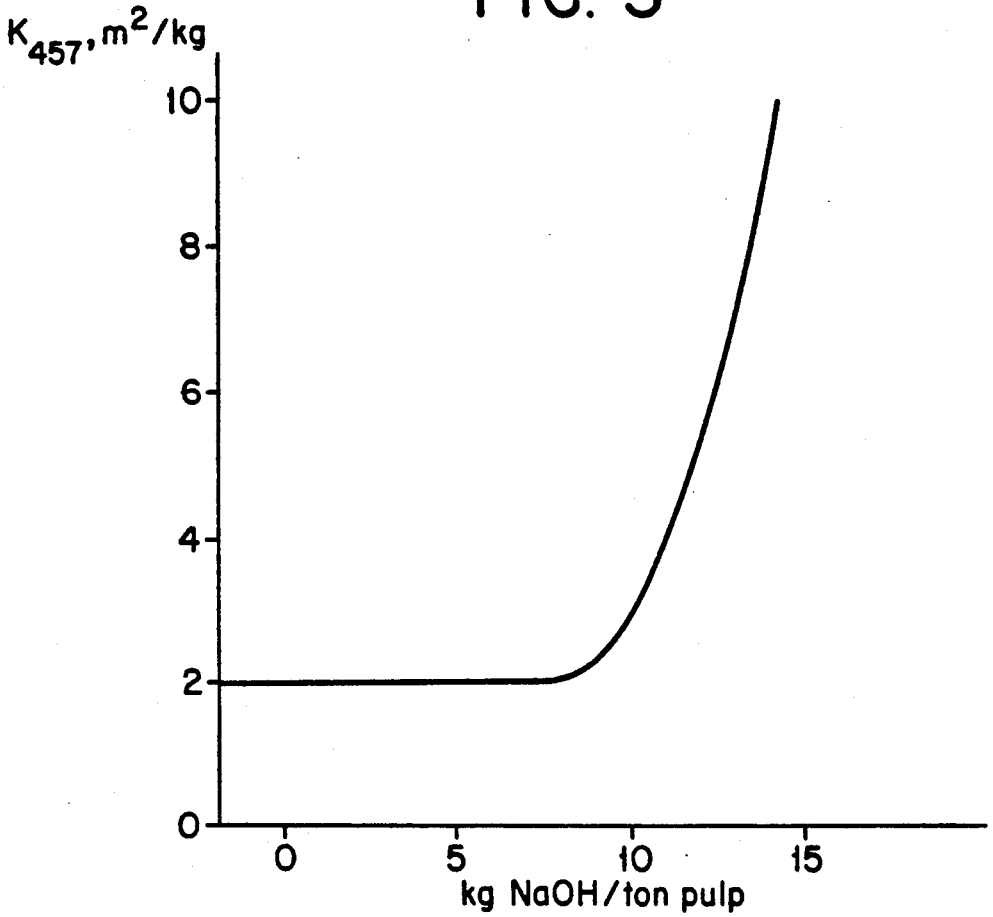
FIGS. 3 and 4 show the light absorption coefficient and diffuse blue reflectance as a function of the amount of alkali added at the beating to equal energy consumption.
Figure 4:
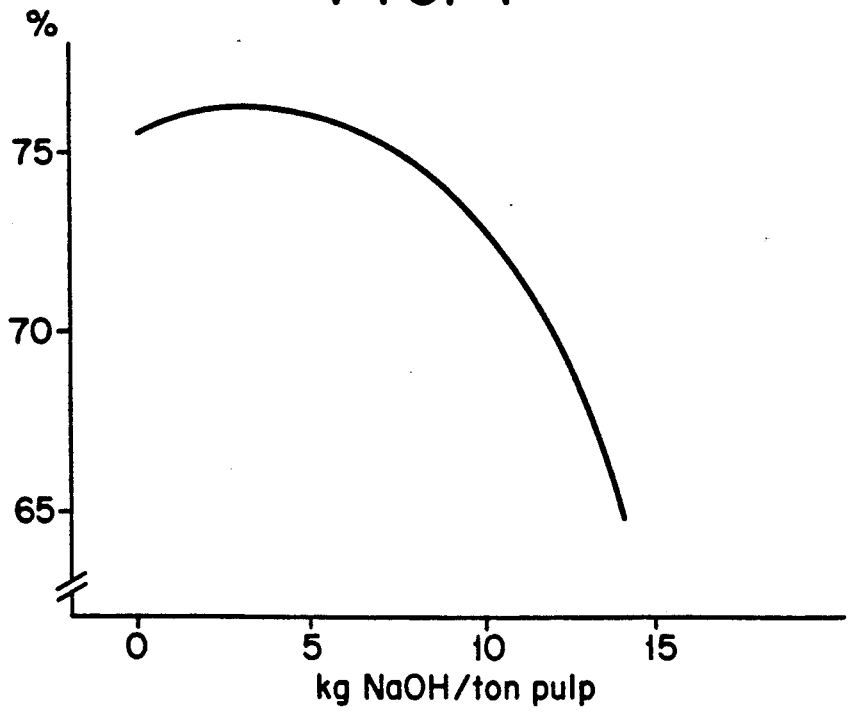

Thermomechanical pulp was manufactured in a pilot mill according to the principle as follows: the accept fraction from a spruce chip lot was vapour steamed at 100° C. for 15 minutes, whereafter it was water-impregnated. The chips, which then had a dry matter content of 39%, were preheated at 127° C. for 5 minutes with direct steam. The chips thereafter were refined in one refiner step to pulp of different freeness degrees. At the refining 4 kg NaOH per ton bone-dry chips were added for obtaining minimum consumption of electric energy to a certain tensile index and light-scattering coefficient according to the invention. See FIGS. 1 and 2. Reference pulp was manufactured in the same way as above, except that only water was added in usual manner at the refining (dilution water always is added at the refining of chips for the manufacture of mechanical pulp). Also the reference pulp was manufactured to different freeness degrees. The characteristics of the alkali-treated pulp and of the reference pulp were then compared according to the following

TABLE 1.

The properties of the pulps in this case are compared on the basis of a definite tensile index value. All properties are determined according to SCAN, except the STFI-shives content, which is a relatively new optical method described in STFI-Information Series A No 429 and the light absorption coefficient, k, measured at 457 nm according to SCAN-research No 107.

TABLE 1

| Pulp characteristics | Reference pulp | Pulp according to the invention |
|---|---|---|
| Tensile index, kNm/kg | 32 | 32 |
| Tensile stiffness index, Nm/kg 3.2 | 4.0 | |
| Tear index, $Nm^2/kg$ | 9.6 | 9.9 |
| Density, $kg/m^3$ | 340 | 360 |
| Freeness, ml CSF | 275 | 350 |
| STFI-shives content,number/g | 3700 | 2900 |
| Extract DKM, % | 0.27 | 0.15 |
| Light scattering coefficient, $m^2/kg$ | 47.5 | 47.5 |
| Light absorption coefficient $m^2/kg$ | 7.0 | 7.0 |
| Diffuse blue reflectance, % ISO | 58.5 | 58.5 |

TABLE 1-continued

| Pulp characteristics | Reference pulp | Pulp according to the invention |
|---|---|---|
| Bleached diffuse blue reflectance, % ISO | 76.0 | 76.0 |
| Electric energy consumption, kWh/ton | 2100 | 1650 |

An alternative description of the comparison between the pulps is shown in Table 2 where the comparison is carried out at equal electric energy comsumption. The properties of the pulps are determined in the same way as above.

TABLE 2

| Pulp characteristics | Reference pulp | Pulp according to the invention |
|---|---|---|
| Tensile index, kNm/kg | 32.0 | 37.0 |
| Tensle stiffness index, Nm/kg | 3.2 | 4.3 |
| Tear index, $Nm^2/kg$ | 9.6 | 9.8 |
| Density, $kg/m^3$ | 340 | 380 |
| Freeness, ml CSF | 275 | 250 |
| STFI-shives content,number/g | 3700 | 2400 |
| Extract DKM, % | 0.27 | 0.15 |
| Light scattering coefficient, $m^2/kg$ | 47.5 | 51.5 |
| Light absorption coefficient, $m^2/kg$ | 7.0 | 7.0 |
| Diffuse blue reflectance, % ISO | 58.5 | 59.7 |
| Bleached diffuse blue reflectance, % ISO | 76.0 | 76.7 |
| Electric energy consumption kWh/ton | 2100 | 2100 |

The comparison according to Table 1 shows, that the method according to the invention, inspite of a saving of as much as 450 kWh/t, a pulp is obtained which has the same, or in some cases (tear index, STFI-shives content, DKM and freeness) even better properties. When making a comparison according to Table 2, all properties of interest, for example, for newsprint apparently have been improved considerably.

A safe explanation for the considerable improvements in properties and, alternatively, the saving in electric energy consumption cannot be given. It is probable, however, that the neutralisation of the acid end groups by the added alkali results in an increase of the swelling capacity of the fibres of the wood and pulp, which in turn increases its capacity of taking up energy. The reason why there is an optimum should be in such case, that at the addition of too much alkali the swelling again decreases, due to the fact that the acid end groups, which now are charged negatively, are screened by an excess of positive ions (from the alkali).

The invention is not restricted to the examples shown, but can be varied within the scope of the invention idea.

We claim:

1. A method of reducing the energy consumption at the refining or beating of cellulose containing material to predetermined strength properties and with reduced shieves and resin content which comprises adding alkali to the material for neutralizing acid groups bounded to the fibre wall, said alkali being added to the material in the refining zone or immediately before the material enters the refining zone, and said alkali being added as sodium hydroxide in an amount of about 1–4 kg per ton for neutralization without excess.

* * * * *